United States Patent [19]

Freissmuth et al.

[11] 4,049,442

[45] Sept. 20, 1977

[54] COMPOSITION FOR DESULFURIZING IRON MELTS

[75] Inventors: Alfred Freissmuth, Trostberg; Walter Heinl, Garching; Herbert Knahl; Erich Pfluger, both of Trostberg, all of Germany

[73] Assignee: Suddeutsche Kalkstickstoff-Werke Aktiengesellschaft, Trostberg, Germany

[21] Appl. No.: 646,778

[22] Filed: Jan. 6, 1976

[30] Foreign Application Priority Data

Jan. 8, 1975 Germany ..... 2500497

[51] Int. Cl.[2] ..... C21C 7/00

[52] U.S. Cl. ..... 75/55; 75/53; 75/58

[58] Field of Search ..... 75/53, 55, 58

[56] References Cited

U.S. PATENT DOCUMENTS

| | | | |
|---|---|---|---|
| 3,551,139 | 12/1970 | Schokkenbroek | 75/53 |
| 3,929,464 | 12/1975 | Todd | 75/58 |

*Primary Examiner*—P. D. Rosenberg

*Attorney, Agent, or Firm*—Burgess, Dinklage & Sprung

[57] ABSTRACT

Iron melts, particularly iron melts made by the torpedo ladle method, can be efficiently desulfurized by adding thereto a mixture of calcium carbide and diamide lime wherein the content of diamide lime is from 40 to 70% by weight of the desulfurizing composition.

8 Claims, No Drawings

COMPOSITION FOR DESULFURIZING IRON MELTS

The present invention is concerned with compositions for desulfurizing iron melts and with a desulfurizing process for iron melts utilizing such compositions.

Desulfurizing agents based on calcium carbide and diamide lime are disclosed in German Pat. No. 1,758,250. The value of desulfurization mixtures which contain diamide lime in addition to finely ground calcium carbide in the iron and steel industry is well recognized.

At the time of the development of this desulfurizing agent, the post-treatment of iron melts was predominantly carried out in open ladles with a filling weight of up to 80 tons. The nature and dimensions of the treatment vessels also determined the quantitative composition of the desulfurizing agents and especially the proportion of diamide lime. Thus, a proportion of 40% by weight of an additive material giving off carbon dioxide, such as diamide lime, constituted the extreme limit above which the use thereof was precluded due to the appearance of operational difficulties (see German Pat. No. 1,758,250). The operational difficulties consisted essentially of a splattering of some of the melt and slag. At the same time, the amount of carbide in the slag, which is in any case undesired, also increased, this being attributable to an incomplete utilization of the carbide employed for the desulfurizing.

In the meantime, closed treatment vessels have come into use in steelworks, i.e, so-called torpedo ladles which have a filling weight of up to about 600 tons. A thorough desulfurizing of this volume of melt with known desulfurizing agents has proven very difficult. In particular, there is a danger of non-homogeneous desulfurization which, in part, is attributable to the completely different flow conditions in the melt in the torpedo ladles in comparison with the melt in open ladles. In order to be able to at least reduce these difficulties, the desulfurizing agent has to be introduced into the melt at several points, which results in additional manufacturing costs.

The present invention substantially overcomes the above-mentioned difficulties and provides a desulfurizing agent which can also be used in torpedo ladles without requiring additonal operational adaptations and permits a utilization of the carbide content of the desulfurizing agent which is as complete as possible.

Surprisingly, we have now found that the proportion of diamide lime can, in the case of desulfurizing torpedo ladles, be increased far above 40% by weight. We have also found that the operational difficulties in open ladles due to the strong carbon dioxide evolution when using high proportions of diamide lime can not only be satisfactorily controlled but that this actually makes possible, for the first time, a thorough desulfurizing of the total melt. Use of the instant compositions leads to a saving of time with, nevertheless, more uniform desulfurization of the treated iron melts.

The composition of the present invention for the desulfurizing of iron melts in torpedo ladles comprises a mixture of calcium carbide and diamide lime in which the content of diamide lime is from more than 40 and up to 70% by weight, based on the total calcium carbide/-diamide lime composition.

It is assumed that the advantageous effects achieved with the desulfurizing agent according to the present invention are due to the different type of spatial conditions in torpedo ladles in comparison with open treatment vessels. The altered flow conditions of the melt in the torpedo ladles have been found to make completely unnecessary the use of a comparatively great immersion depth for the blowing in lances which is necessary in the case of open vessels for a homogeneous desulfurizing. Thus, the ferrostatic pressure in the melt inhibits the bubble formation which impairs the mixing up of the melt.

The desulfurizing agent according to the present inventon can be blown into the melt in conventional manner, using a carrier gas stream, by means of a blowing in lance. According to a preferred embodiment there are introduced into the iron melt intermittently about the same amounts and/or after certain time lags differing amounts of the desulfurizing agent, possibly with increasing or decreasing carrier gas current. In this way, the period of treatment can be shortened.

The desulfurizing composition according to the present invention also permits avoiding the previously employed laborious method of working (see Japanese Pat. No. 21205/74, according to which, in the case of comparatively large torpedo ladles, it was necessary to blow in the desulfurizing agent with several lances at different points.

The desulfurizing composition according to the present invention permits the use of a single lance, the simplification of the blowing in plant, a saving of desulfurizing agent (the carbide component of which is the most expensive component) and an acceleration of the desulfurizing throughout, i.e, overall it results in an advantageous method of working. Furthermore, with the use of the desulfurizng agent according to the present invention, it is possible to obtain a carbide-free slag.

The following examples are given for the purpose of illustrating the present invention:

EXAMPLE 1

In the case of several series of torpedo ladles filled with 300 tons of crude iron, there is used a desulfurizing mixture of calcium carbide, and diamide chalk in a weight ratio of 75:25 or 50:50 , the blowing rate being, in each case, about 110 kg./minute.

| | |
|---|---|
| average initial sulfur content | 0.055% |
| desired final sulfur content | 0.020% |
| Mixture 75:25 | Mixture 50:50 |
| 4.9 kg./ton crude iron | 4.8 kg./ton crude iron |
| homogeneity samples | (final sulfur content) |
| 0.014 –0.021 | 0.015 –0.019 |

EXAMPLE 2

The influence of an addition of desulfurizing agent pulsating between 60 and 130 kg./minute was tested in several series of experiments using torpedo ladles filled with 300 tons of crude iron.

In this way, the treatment time could be reduced by about 25%, in comparison with Example 1.

a. identical requirements, other conditions as in Example 1 13 minute treatment period
b. pulsating supply of 60–130 kg./minute average treatment period 9.5 minutes.

It will be understood that the specification and examples are illustrative but not limitative of the present invention and that other embodiments within the spirit and scope of the invention will suggest themselves to those skilled in the art.

What is claimed is:

1. Composition for desulfurizing iron melts in torpedo ladles, comprising a mixture of calcium carbide and diamide line in which the content of diamide lime is from more than 40% by weight up to 70% by weight of the mixture.

2. Desulfurizing composition as claimed in claim 1 comprising about 50% by weight of diamide lime and about 50% by weight of calcium carbide.

3. Process for the desulfurization of iron melts in torpedo ladles which process comprises adding to the iron melt a composition as claimed in claim 1.

4. Process as claimed in claim 3 wherein said composition is introduced into said iron melt intermittently.

5. Process as claimed in claim 4 wherein said composition is employed in equal doses.

6. Process as claimed in claim 4 wherein said composition is employed in varying doses per unit period of time between said intermittent introduction.

7. Process as claimed in claim 3 wherein said composition is introduced into the iron melt by blowing it in in a current of carrier gas.

8. Process as claimed in claim 7 wherein the carrier gas stream flow rate is varied over time.

* * * * *